US009290246B1

(12) United States Patent
Till

(10) Patent No.: US 9,290,246 B1
(45) Date of Patent: Mar. 22, 2016

(54) ADJUSTABLE MARINE FENDER HOLDER

(71) Applicant: Silver Fox Capital LLC, Dallas, TX (US)

(72) Inventor: Walter J. Till, Dallas, TX (US)

(73) Assignee: Silver Fox Capital LLC, Dallas, TX (US)

( * ) Notice: Subject to any disclaimer, the term of this patent is extended or adjusted under 35 U.S.C. 154(b) by 0 days.

(21) Appl. No.: 14/267,007

(22) Filed: May 1, 2014

Related U.S. Application Data

(60) Provisional application No. 61/882,118, filed on Sep. 25, 2013.

(51) Int. Cl.
*B63B 59/02* (2006.01)

(52) U.S. Cl.
CPC ..... *B63B 59/02* (2013.01)

(58) Field of Classification Search
USPC ..... 114/218
IPC ..... B63B 21/04,59/02
See application file for complete search history.

(56) References Cited

U.S. PATENT DOCUMENTS

| | | | | |
|---|---|---|---|---|
| 4,998,495 | A * | 3/1991 | Bos et al. | 114/218 |
| 6,158,919 | A * | 12/2000 | Landes | 404/9 |
| 6,163,936 | A * | 12/2000 | Benoit | 24/130 |
| 7,775,176 | B2 | 8/2010 | Abel | |
| 8,397,350 | B2 * | 3/2013 | Yeames | 24/129 R |
| 2008/0257273 | A1 * | 10/2008 | Carter et al. | 119/72 |

* cited by examiner

*Primary Examiner* — Stephen Avila
(74) *Attorney, Agent, or Firm* — Frost Brown Todd LLC

(57) ABSTRACT

Described herein is an adjustable marine fender holder comprising: a cylindrical body comprising a hole, the hole sized to receive a rope connected to a marine fender; a rope jam coupled angularly to the cylindrical body, the rope jam comprising a channel, the channel comprising a plurality of teeth configured to grip the rope.

17 Claims, 3 Drawing Sheets

ADJUSTABLE MARINE FENDER HOLDER

CROSS REFERENCE TO RELATED INFORMATION

This application claims the benefit of U.S. Provisional Patent Application No. 61/882,118, filed Sep. 25, 2013, titled "It's a one piece fender adjuster holder that secures the fender utilizing the existing rod holders on the boat. It can be inserted and adjusted using one hand."

TECHNICAL FIELD

The present disclosure is directed to an adjustable marine fender holder.

BACKGROUND OF THE INVENTION

Boats and other vessels that travel on water may occasionally dock at a quay or other docking platform to load or unload cargo and/or passengers. When a vessel is berthing against another vessel or object, a marine fender may be used to prevent the boat or vessel from rubbing against the other object. By using a marine fender, the vessel may avoid damage that would be caused by constant rubbing or bumping into the quay or other object. Some marine fenders are fixed to a vessel or other object. Some marine fenders are removable. Removable marine fenders may be deployed when a vessel is approaching a berthing to avoid damage as described above. The removable marine fenders may be suspended from the side of the vessel using a rope. As used herein, the term rope includes any type of line used to suspend an object from or secure an object to a boat or other vessel.

BRIEF SUMMARY OF THE INVENTION

Described herein is an adjustable marine fender holder comprising: a cylindrical body comprising a hole, the hole sized to receive a rope connected to a marine fender holder; a rope jam coupled angularly to the cylindrical body, the rope jam comprising a channel, the channel comprising a plurality of teeth configured to grip the rope.

Also described herein is a method for adjusting a marine fender comprising: feeding a rope through a hole in an adjustable marine fender holder, wherein the rope is connected to a marine fender; pulling the rope through the hole to a desired length; and securing the rope into a rope jam comprising a plurality of teeth configured to hold the rope.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
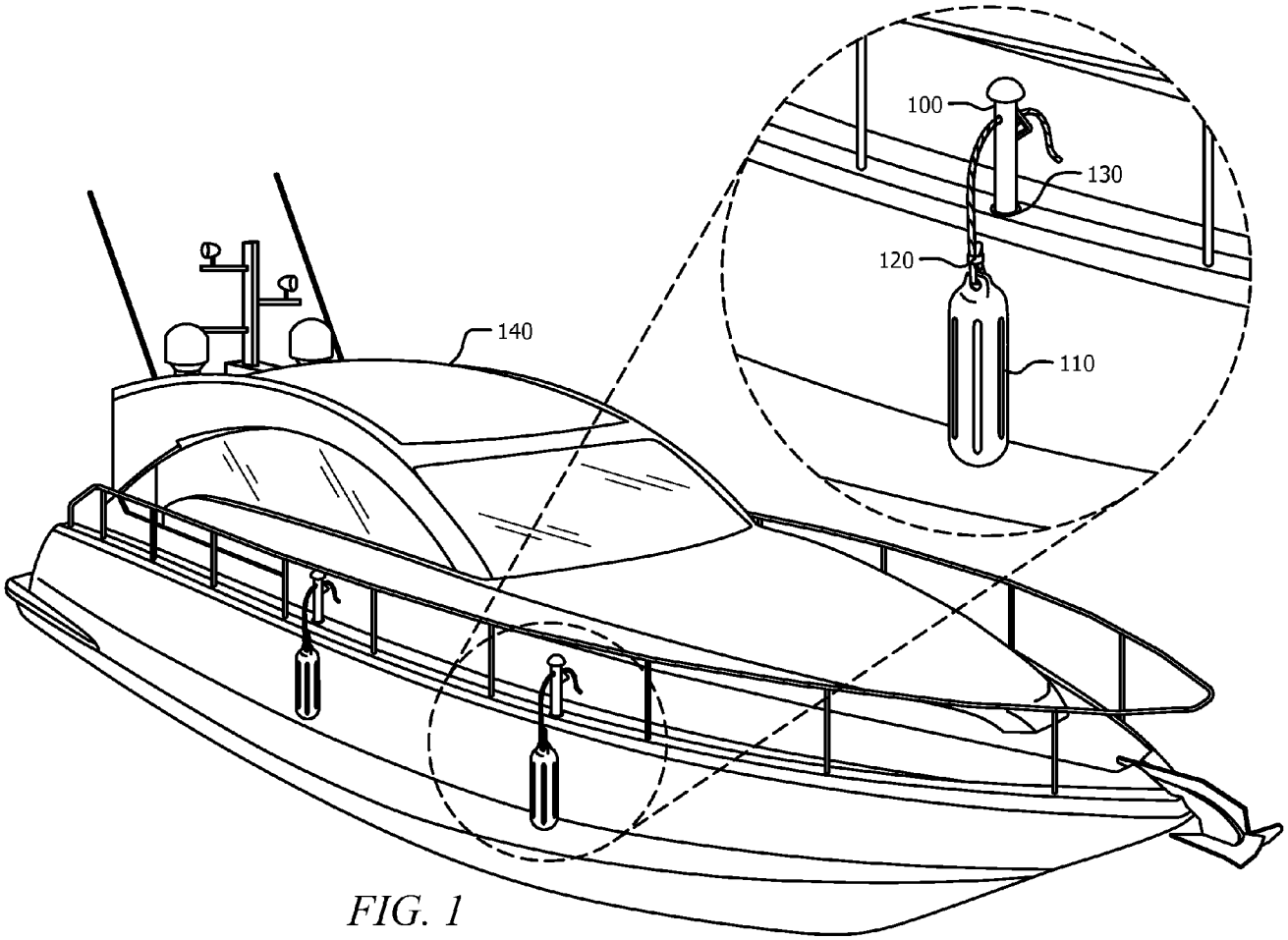
FIG. 1 is a diagram of a vessel with an adjustable marine fender holder installed.
Figure 2:
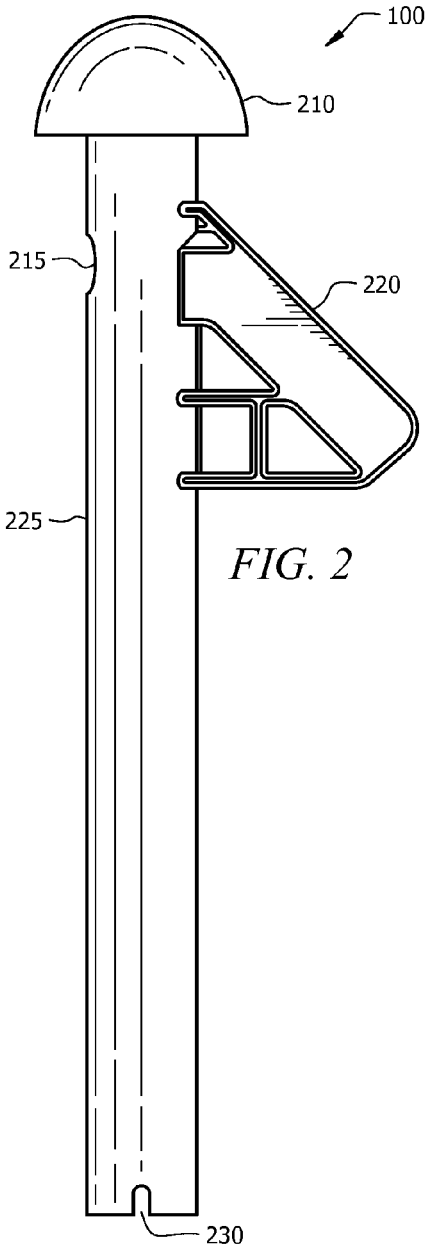
FIG. 2 is a side view of a preferred embodiment of an adjustable marine fender holder.
Figure 3:
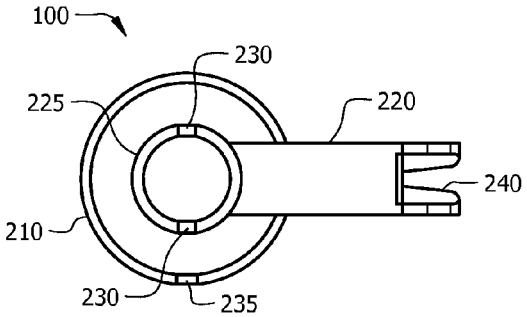
FIG. 3 is a bottom view of a preferred embodiment of an adjustable marine fender holder.
Figure 4:
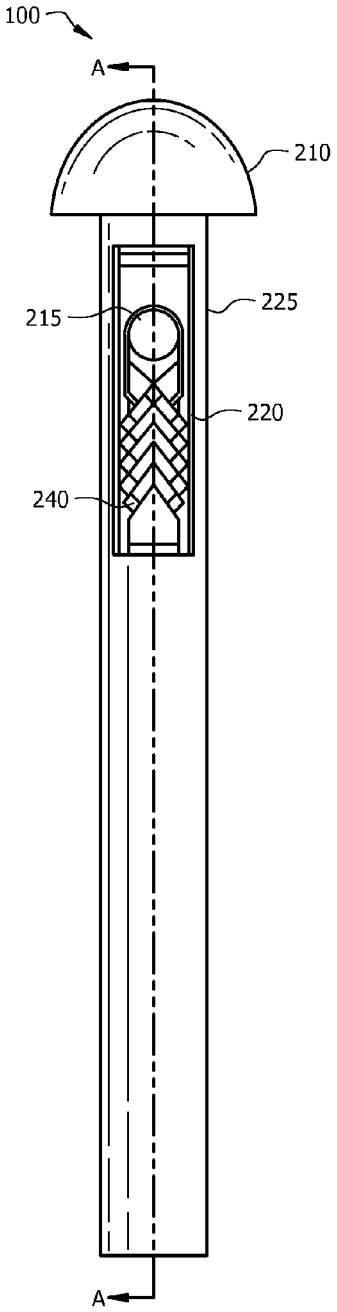
FIG. 4 is a front view of a preferred embodiment of an adjustable marine fender holder.
Figure 5:
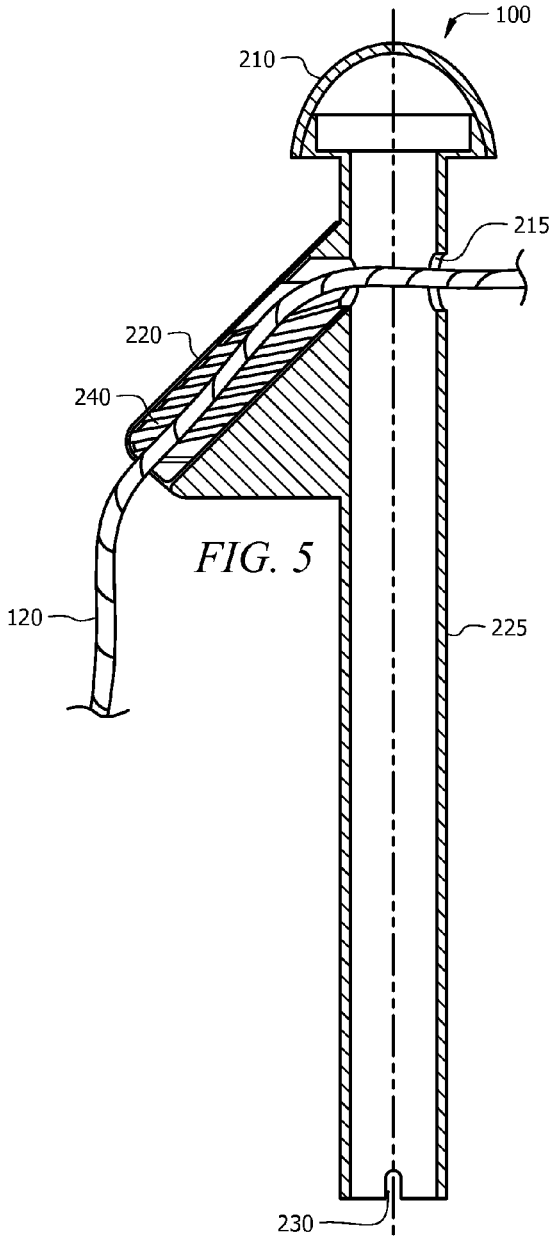
FIG. 5 is a sectional view of a preferred embodiment of an adjustable marine fender holder.

Referring now to FIG. 1, a diagram of a vessel 140 with an adjustable marine fender holder 100 installed is presented. The adjustable marine fender holder 100 may be installed in a typical rod holder 130 on vessel 140. A fender 110 may be secured with a rope 120 to adjustable marine fender holder 100. Rope 120 may also be referred to herein as a line. Rope 120 passes through a hole in adjustable marine fender holder 100 and is secured in a rope jam. The rope 120 may be pulled or released in order to adjust the height at which the fender 110 hangs from the vessel 140. The height may be adjusted to ensure that the fender 110 is between vessel 140 and a dock or surface the vessel 140 may come into contact with. While vessel 140 is depicted as a boat with a cabin, adjustable marine fender holder 100 may be used with any type of vessel that has rod holders, for example a center console, walk around, or open bow boat.

FIG. 2-FIG. 5 present various views of adjustable marine fender holder 100. Adjustable marine fender holder 100 may have a cylindrical body 225. Cylindrical body 225 may be hollow or solid. The length of cylindrical body 225 may vary depending on the depth of the rod holder that the adjustable marine fender holder 100 will be used with. For example, the length of cylindrical body 225 may be several inches or several feet. In a preferred embodiment, the length of the body may be selected such that the adjustable marine fender holder 100 rests at a point such that a rope jam 220 is about one to one and a half inches above the top of the rod holder. The diameter of cylindrical body 225 may be selected to fit most rod holders. For example, the diameter may be an inch in diameter or more. The diameter should be sufficient to support the weight of most marine fenders.

Cylindrical body 225 may have a hole 215. Hole 215 may be of a large enough diameter to allow a rope to pass through. A rope jam 220 may be attached to cylindrical body 225. The rope jam 220 may surround a channel for a rope to pass through at a certain angle relative to cylindrical body 225. The angle may for example be 45 degrees. The channel created by rope jam 220 may be a v-shape or some other shape to conform to a rope passed through hole 215. The diameter of hole 215 may be selected to be substantially similar to the width of the channel created by rope jam 220.

Within the channel created by rope jam 220 there may be several teeth 240 used to grip a rope that is pressed into the channel. Teeth 240 may be perpendicular to the angle of the channel formed by rope jam 220. In other embodiments, teeth 240 may be at other angles suitable for gripping a rope pressed in the channel formed by rope jam 220. The teeth 240 may be along the walls of the channel formed by rope jam 220. Teethe 240 may be shaped to create a v-shaped channel, such that ropes of various diameters may be used with the adjustable marine fender holder 100. The number of teeth 240 may vary depending upon the weight of the fender or other factors as determined by a user or manufacturer. The teeth 240 may hold the rope at the position desired by a user of the adjustable marine fender holder 100, thereby adjusting the length at which a fender hangs from a rope to a desired length. As a user pulls a rope through hole 215, the fender will hang at a distance closer to the adjustable marine fender holder 100. As a user releases a rope through hole 215, the fender will hang at a distance further from the adjustable marine fender holder 100.

Adjustable marine fender holder 100 may have one or more notches 230 at its base. Notches 230 may allow the adjustable marine fender holder 100 to remain in a fixed position by sliding over a bar or other raised feature at the bottom of a rod holder. Adjustable marine fender holder 100 may also have a cap 210. Cap 210 may be used to provide an enhanced gripping surface for adjustable marine fender holder 100. Notch 235 may be used for securing cap 210 to cylindrical body 225. In some embodiments, cap 210 may not have a notch 235, for example if cap 210 is friction welded to cylindrical body 225 a notch 235 may not be needed. Adjustable marine fender holder 100 may be made of plastic, thermo-plastic resins, polymers, metals, wood, or other materials as desired by the manufacturer or end user. It may be desirable to choose a material that is resistant to the corrosive atmosphere and exposure to sun that ocean going vessels may encounter. In some embodiments, the adjustable marine fender holder 100 maybe coated with an ultraviolet (UV) protectant to further protect against damage from prolonged exposure to the sun.

While the foregoing description describes the adjustable marine fender holder in the context of marine fenders, other uses may be conceived of for the adjustable marine fender holder, for example as an anchor holder or livewell holder, or any other type of device that may hung by a rope from the side of a vessel.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An adjustable marine fender holder comprising:

a cylindrical body comprising a hole, the hole passing transversely through a longitudinal axis of the cylindrical body, the hole sized to receive a rope connected to a marine fender, the hole comprising a rope entry and a rope exit; and a rope jam coupled angularly to the cylindrical body, the rope jam comprising a channel, the channel comprising a proximal end, a distal end, and a plurality of teeth configured to grip the rope;

wherein the proximal end is situated over the rope exit, and wherein a rope passing through the rope exit is immediately received by the proximal end of the channel.

2. The adjustable marine fender holder of claim 1, wherein the cylindrical body is sized to be smaller than a diameter of a rod holder.

3. The adjustable marine fender holder of claim 2, wherein the cylindrical body further comprises one or more notches sized to receive a raised feature within the rod holder.

4. The adjustable marine fender holder of claim 1 further comprising:

a cap, wherein the cap is a half sphere mounted at a top of the cylindrical body.

5. The adjustable marine fender holder of claim 4, wherein the cap comprises one or more notches.

6. The adjustable marine fender holder of claim 1, wherein the teeth are formed in a v-shape for gripping ropes of various diameters.

7. The adjustable marine fender holder of claim 1, wherein the adjustable marine fender holder is made of one or more of: injection molded plastic, thermo-plastic resins, polymers, metal, and/or wood.

8. The adjustable marine fender holder of claim 1 further comprising an ultraviolet protection coating.

9. A method for adjusting a marine fender comprising:

feeding a rope through a hole in a cylindrical body of an adjustable marine fender holder, the hole comprising a rope entry and a rope exit, wherein the hole passes transversely through a longitudinal axis of the adjustable marine fender holder, wherein the rope is connected to the marine fender;

pulling the rope through the hole to a desired length; and securing the rope into a rope jam, the rope jam comprising a channel, the channel comprising a proximal end, a distal end, and a plurality of teeth configured to hold the rope;

wherein the proximal end is situated over the rope exit, and wherein a rope passing through the rope exit is immediately received by the proximal end of the channel.

10. The method of claim 9, wherein the cylindrical body of the adjustable marine fender holder is sized to be smaller than a diameter of a rod holder.

11. The method of claim 9, wherein the cylindrical body of the adjustable marine fender holder comprises one or more notches sized to receive a raised feature within the rod holder.

12. The method of claim 9, wherein the teeth are formed in a v-shape for gripping ropes of various diameters.

13. The method of claim 9, wherein the adjustable marine fender holder is made of one or more of: injection molded plastic, thermo-plastic resins, polymers, metal, and/or wood.

14. The method of claim 9 wherein the marine fender holder comprises an ultraviolet protection coating.

15. The adjustable marine fender holder of claim 1, wherein the cylindrical body is solid.

16. The adjustable marine fender holder of claim 1, wherein the channel extends outwards and downwards from the cylindrical body at a non-perpendicular angle.

17. The method of claim 10, further comprising the step of inserting the cylindrical body into the rod holder.

* * * * *